US005938569A

United States Patent [19]

Lin

[11] Patent Number: 5,938,569

[45] Date of Patent: Aug. 17, 1999

[54] STEPPING AND SWINGING EXERCISER

[76] Inventor: Ting Fung Lin, 12F-1, No. 83, Suei Yuan Road, Taipei, Taiwan

[21] Appl. No.: 09/097,020

[22] Filed: Jun. 12, 1998

[51] Int. Cl.[6] ..... A63B 22/00

[52] U.S. Cl. ..... 482/52; 482/147

[58] Field of Search ..... 482/51, 52, 53, 482/57, 62, 70, 79, 80, 147, 111; D21/670, 662

[56] References Cited

U.S. PATENT DOCUMENTS

| | | | |
|---|---|---|---|
| 4,563,001 | 1/1986 | Terauds | 482/53 |
| 4,830,362 | 5/1989 | Bull | 482/53 |
| 5,314,392 | 5/1994 | Hawkins | 482/57 |
| 5,545,111 | 8/1996 | Wang et al. | 482/53 |
| 5,645,512 | 7/1997 | Yu | 482/53 |
| 5,749,809 | 5/1998 | Lin | 482/52 |

*Primary Examiner*—Stephen R. Crow

[57] ABSTRACT

An exerciser includes a post having a lower portion rotatably secured to a base. Two bevel gears are secured to the post and the base and are engaged with each other. A pair of foot supports are pivotally supported on the base and are coupled to the bevel gear secured on the base by two cables, such that the foot supports may rotate the post via the bevel gears, and such that the user may twist his body while stepping with the foot supports. The cables may be secured to the bevel gear via a bar which is secured to the bevel gear.

4 Claims, 3 Drawing Sheets

STEPPING AND SWINGING EXERCISER

BACKGROUND OF THE INVENTION

1. Field of the Invention

The present invention relates to an exerciser, and more particularly to a stepping and swinging exerciser.

2. Description of the Prior Art

Two typical stepping exercisers are disclosed in U.S. Pat. No. 5,545,111 to Wang et al. and U.S. Pat. No. 5,645,512 to Yu and comprise a complicated structure for coupling the handle to the foot supports and for allowing the handle to be rotated by the foot supports. However, the structures are complicated such that the manufacturing costs are greatly increased.

The present invention has arisen to mitigate and/or obviate the afore-described disadvantages of the conventional stepping exercisers.

SUMMARY OF THE INVENTION

The primary objective of the present invention is to provide a stepping and swinging exerciser which includes a greatly simplified structure for allowing the user to conduct both stepping and swinging exercises and for decreasing the manufacturing cost of the exerciser.

In accordance with one aspect of the invention, there is provided an exerciser comprising a base, a post including a lower portion rotatably secured to the base, a first coupling member secured to the post and rotated in concert with the post, a second coupling member rotatably supported on the base at a pivot shaft and engaged with the first coupling member for allowing the second coupling member to rotate the post via the first coupling member, a pair of foot supports pivotally supported on the base, and means for coupling the foot supports to the second coupling member and to actuate the second coupling member to rotate the post via the first coupling member.

The coupling members are bevel gears which are engaged with each other. The foot support coupling means includes a pair of cables each being secured between the foot support and the second coupling member. A bar is secured to the second coupling member, the cables are secured between the ends of the bar and the foot supports respectively. A resistive means is further provided for applying a resistive force against the foot supports.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 2:
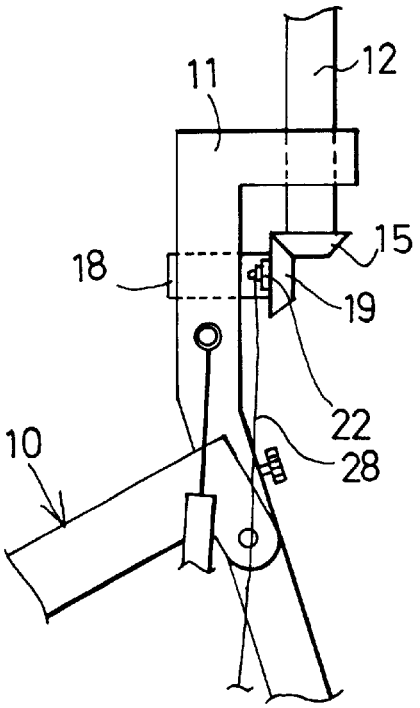
FIG. 2 is a partial plan view of the exerciser.
Figure 1:
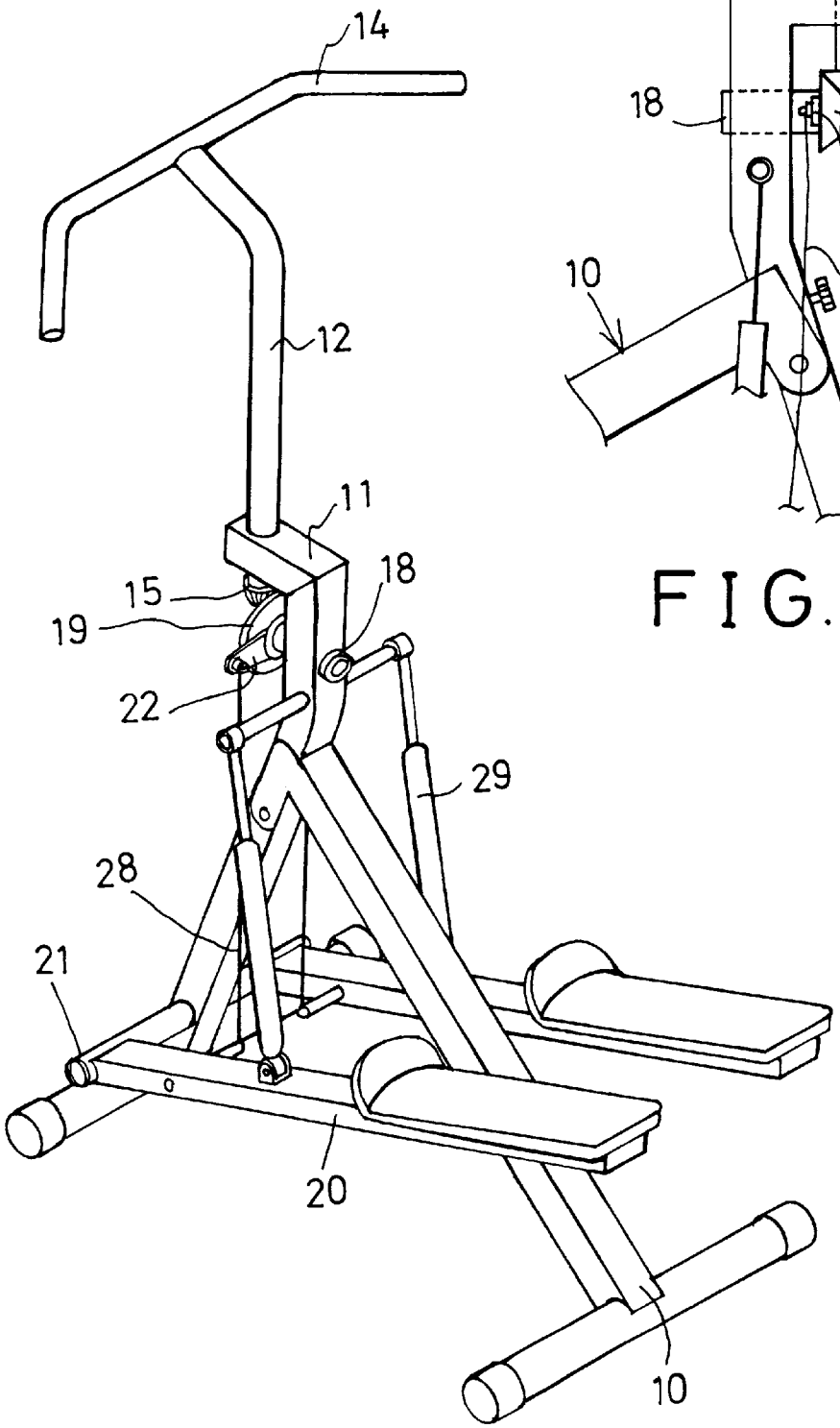
FIG. 1 is a perspective view of an exerciser in accordance with the present invention.

Referring to the drawings, and initially to FIGS. 1–2, a stepping and swinging exerciser in accordance with the present invention comprises a base 10 including an extension 11 extended forward from the upper portion and a post 12 having a lower portion rotatably secured in the extension 11 and having a handle 14 provided on top thereof. The post 12 may also be rotatably secured to the base 10 directly without the extension 11. A bevel gear 15 is secured on the lower portion of the post 12. Another bevel gear 19 is rotatably secured on the upper portion the base 10 at a pivot shaft 18 and engaged with the bevel gear 15 such that the post 12 may be rotated by the bevel gear 19 via the bevel gear 15. A bar 22 is secured to the bevel gear 19 and rotated in concert with the bevel gear 19.

A pair of foot supports 20 each includes a front portion pivotally secured to the base 10 at a pivot axle 21 for allowing the foot supports 20 to be rotated about the pivot axle 21. A pair of links, such as a pair of cables 28, have an upper end secured to the ends of the bar 22 and have the lower end secured to the foot supports 20 respectively, such that the bevel gear 19 may be rotated by the foot supports 20 via the links 28 and the bar 22, and such that the post 12 and the handle 14 may be rotated by the foot supports 20 via the bevel gears 15, 19 and the links 28. The links 28 may also be directly secured to the bevel gear 19 instead of securing to the bar 22, the bevel gear 19 may also be rotated by the foot supports 20 via the links 28 without the bar 22. Two actuators 29 may be secured between the foot supports 20 and the base 10 for applying a resistive force against the foot supports 20.

Figure 4:
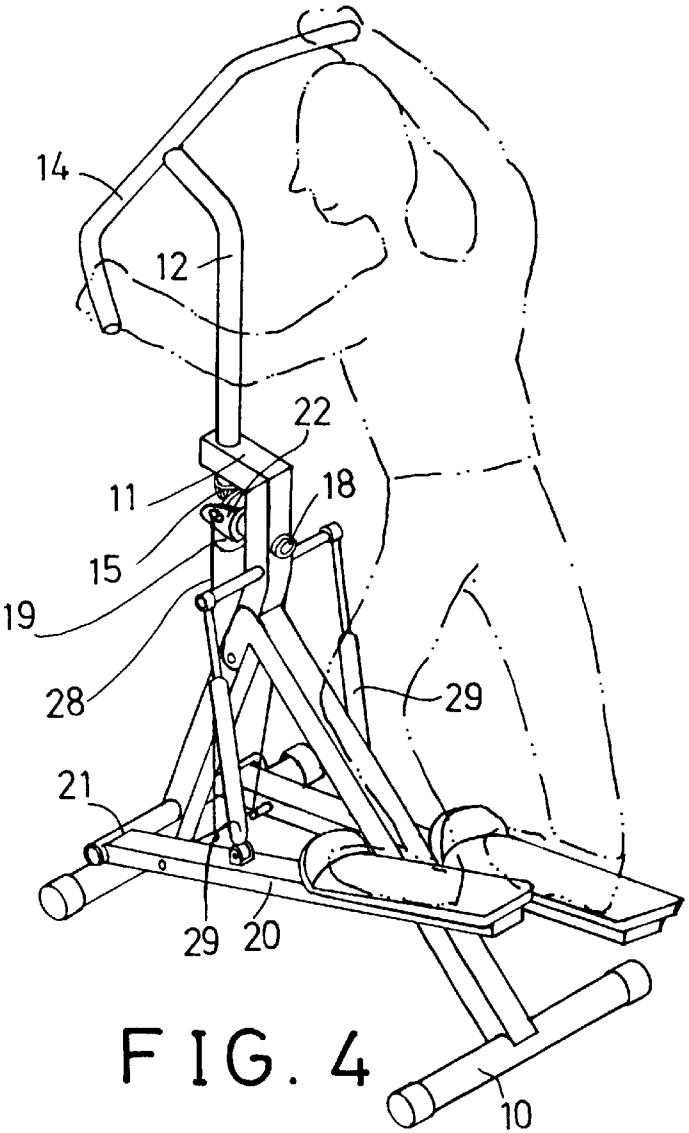
FIGS. 3 and 4 are perspective views illustrating the operation of the exerciser.
Figure 3:
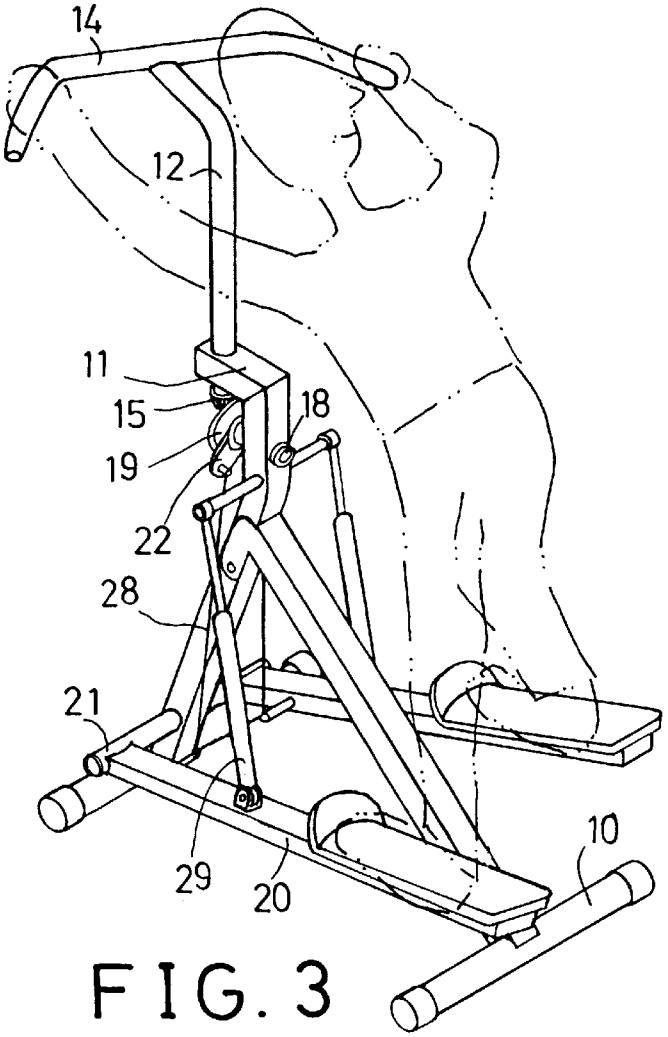

In operation, the bevel gear 19 may be rotated about the pivot shaft 18 by the foot supports 20 in order to rotate the post 12 and the handle 14 via the bevel gears 15, 19, such that the user may conduct swinging exercise in addition to the stepping exercise. As shown in FIG. 3, the post 12 is preferably rotated clockwise when the left foot support 20 is stepped downward. The post 12 may be rotated counterclockwise when the right foot support 20 is stepped downward (FIG. 4).

Figure 6:
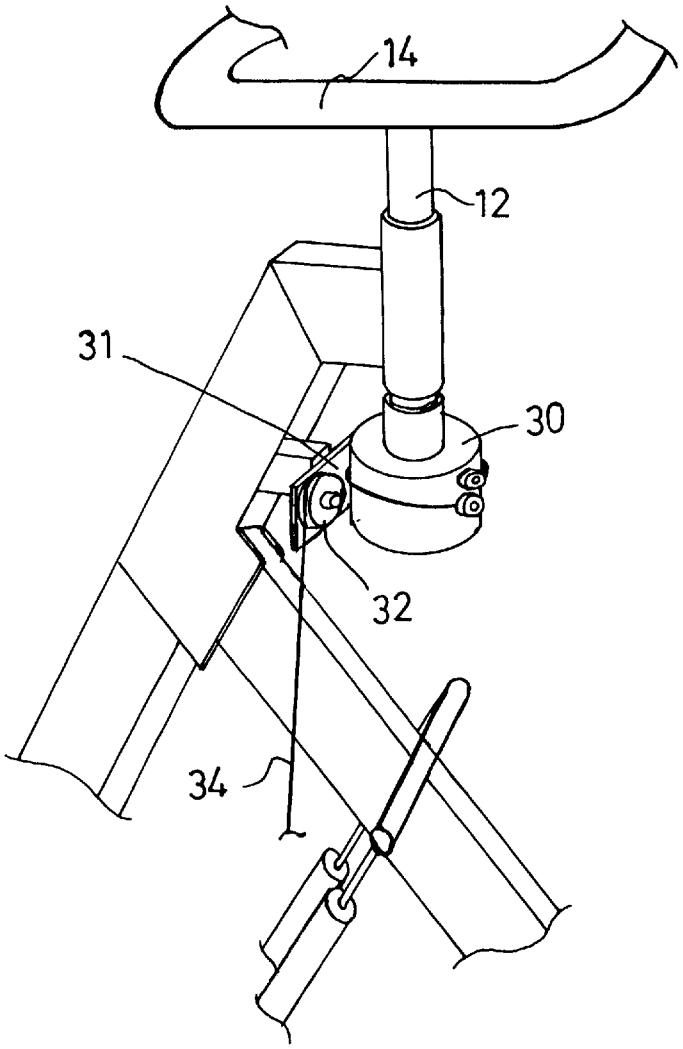
FIG. 6 is an enlarged partial perspective view of the exerciser as shown in FIG. 5.
Figure 5:
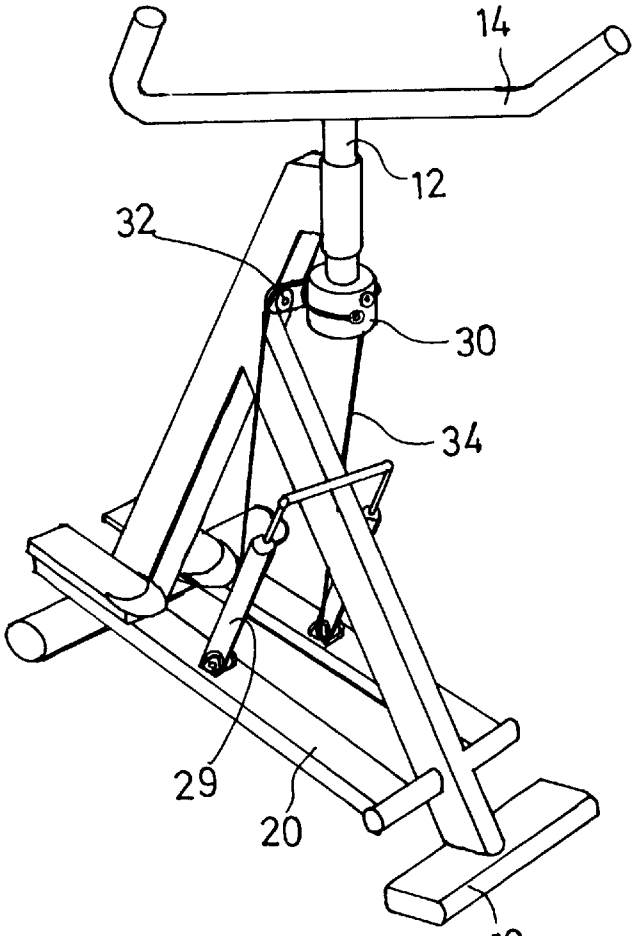
FIG. 5 is a perspective view illustrating a further application of the exerciser.

Referring next to FIGS. 5 and 6, instead of the bevel gears 15, 19, a follower 30 is secured to the post 12 and rotated in concert with the post 12. Two pulleys 32 are rotatably secured to a beam 31 which is secured to the upper portion of the base 10. Two links 34 have a lower end secured to the foot supports 20 and have an upper end engaged over the pulleys 32 and secured to the follower 30, such that the follower 30 and thus the post 12 may also be rotated by the foot supports 20 via the links 34 and the pulleys 32 and the follower 30. The upper portions of the links 34 are engaged over about one half of the follower 30. FIG. 5 shows a front perspective view of the exerciser. The post 12 may also be rotated clockwise when the left foot of the user is stepped downward. The post 12 may be rotated counterclockwise when the right foot of the user is stepped downward.

Accordingly, the exerciser in accordance with the present invention includes a greatly simplified structure for allowing the user to conduct both stepping and swinging exercises and for decreasing the manufacturing cost of the exerciser.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exerciser comprising:

a base, a post including a lower portion rotatably secured to said base, a first coupling member secured to said post and rotated in concert with said post, a second coupling member rotatably supported on said base at a pivot shaft and engaged with said first coupling member for allowing said second coupling member to rotate said post via said first coupling member, a pair of foot supports pivotally supported on said base, and a pair of cables secured between said foot supports and said second coupling member for coupling said foot supports to said second coupling member and to actuate said second coupling member to rotate said post via said first coupling member.

2. The exerciser according to claim 1, wherein said first coupling member and said second coupling member are bevel gears which are engaged with each other.

3. The exerciser according to claim 1 further comprising a bar secured to said second coupling member and having two ends, said cables are secured between said ends of said bar and said foot supports respectively.

4. The exerciser according to claim 1 further comprising means for applying a resistive force against said foot supports.

* * * * *